US009183976B2

(12) United States Patent
Hanchett, Jr. et al.

(10) Patent No.: US 9,183,976 B2
(45) Date of Patent: Nov. 10, 2015

(54) SPRINGLESS ELECTROMAGNET ACTUATOR HAVING A MODE SELECTABLE MAGNETIC ARMATURE

(71) Applicant: Hanchett Entry Systems, Inc., Phoenix, AZ (US)

(72) Inventors: Leland J. Hanchett, Jr., Cave Creek, AZ (US); Dominik Scheffler, Phoenix, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 139 days.

(21) Appl. No.: 13/833,671

(22) Filed: Mar. 15, 2013

(65) Prior Publication Data

US 2013/0241680 A1 Sep. 19, 2013

Related U.S. Application Data

(60) Provisional application No. 61/612,590, filed on Mar. 19, 2012.

(51) Int. Cl.
*H01F 7/16* (2006.01)

(52) U.S. Cl.
CPC ..... *H01F 7/16* (2013.01); *H01F 7/1615* (2013.01)

(58) Field of Classification Search
CPC .. H01F 2003/103; H01F 7/122; H01F 7/1615
USPC ..... 335/229
See application file for complete search history.

(56) References Cited

U.S. PATENT DOCUMENTS

| | | | | |
|---|---|---|---|---|
| 3,022,400 | A * | 2/1962 | Von Ahlefeldt | 335/81 |
| 3,218,523 | A | 11/1965 | Benson | |
| 3,504,320 | A * | 3/1970 | Engdahl et al. | 336/110 |
| 3,775,714 | A * | 11/1973 | Heuer | 335/230 |
| 4,533,890 | A * | 8/1985 | Patel | 335/234 |
| 5,559,378 | A * | 9/1996 | Oudet et al. | 310/17 |
| 5,947,155 | A * | 9/1999 | Miki et al. | 137/625.65 |
| 6,040,752 | A * | 3/2000 | Fisher | 335/234 |
| 6,932,317 | B2 | 8/2005 | Gnadinger et al. | |
| 2004/0095219 | A1 * | 5/2004 | Kelly | 335/229 |
| 2008/0164964 | A1 * | 7/2008 | Nelson | 335/229 |
| 2011/0001591 | A1 * | 1/2011 | Puth et al. | 335/229 |

FOREIGN PATENT DOCUMENTS

| | | | |
|---|---|---|---|
| DE | 3423469 | A1 * | 1/1986 |
| JP | 58025207 | A * | 2/1983 |

* cited by examiner

*Primary Examiner* — Mohamad Musleh
(74) *Attorney, Agent, or Firm* — Woods Oviatt Gilman LLP; Ronald J. Kisicki, Esq.

(57) ABSTRACT

A standard solenoid body and coils are combined with a non-magnetic armature tube containing a permanent magnet, preferably neodymium. The magnet is located in one of three positions within the armature. When biased toward the stop end of the solenoid, it may be configured to act as a push solenoid. When biased toward the collar end of the solenoid, it may be configured to act as a pull solenoid. In either case, no spring is required to return the armature to its de-energized position. Positioning the magnet in the middle of the armature defines a dual-latching solenoid requiring no power to hold it in a given state. A positive coil pulse moves the armature toward the stop end, whereas a negative coil pulse moves the armature toward the collar end. The armature will remain at the end to which it was directed until another pulse of opposite polarity comes along.

22 Claims, 8 Drawing Sheets

SPRINGLESS ELECTROMAGNET ACTUATOR HAVING A MODE SELECTABLE MAGNETIC ARMATURE

This application claims the benefit of U.S. Provisional Application No. 61/612,590, filed Mar. 19, 2012.

TECHNICAL FIELD

The present invention relates to electromagnetic solenoid actuators; more particularly, to electromagnet actuators having a magnet contained within the armature; and most particularly, to an actuator having a permanent magnet, preferably a rare earth magnet, contained within a non-magnetic armature, wherein the magnet is shorter than the non-magnetic armature, and wherein the magnet may be selectively positioned at or near the longitudinal center of the armature for double-acting utility, or biased in position toward one end or the other to configure the actuator to be either a pull-type or push-type, without a need for a biasing spring.

BACKGROUND OF THE INVENTION

A standard prior art electromagnetic actuator, hereinafter referred to as a "solenoid", typically comprises an electrical coil wound on a hollow bobbin. A ferromagnetic pole piece and an armature are disposed within or proximate the bobbin, and the magnetic field generated by the coil when energized causes the armature to move axially of the coil toward the pole piece. The armature and solenoid housing are then specially configured for either push or pull solenoids. The position of the armature with respect to the pole piece when the solenoid is de-energized is provided by a biasing spring that drives the armature away from the pole piece.

A "push" solenoid includes a plunger portion extending from the armature ("plunger") through the pole piece and terminating at a point outside the pole piece end of the solenoid. When the coil is energized, the armature moves toward the pole piece and the plunger pushes outwardly of the solenoid housing. A bias spring moves the armature away from the pole piece when the coil is de-energized, causing the plunger to retract. A "pull" solenoid on the other hand is closed at the pole piece end. An opening at the opposite end allows a plunger portion to extend outwardly from the solenoid housing. When the coil is energized, the armature moves toward the pole piece and the plunger is pulled inwardly of the solenoid housing. The bias spring moves the armature away from the pole piece when the coil is de-energized thereby causing the plunger to re-extend, outwardly.

In the solenoid art, it is known to employ a permanent magnet within an armature to bias the armature in one direction or the other, depending upon the polarity of the magnet, to enhance the pull force of the armature in the solenoid and to negate the need for a bias spring; see, for example, in U.S. Pat. No. 3,218,523.

It is also known to employ neodymium as the magnetic material in a solenoid armature; see, for example, U.S. Pat. No. 6,932,317.

What is needed in the art is a solenoid having an armature incorporating a permanent magnet, preferably made of a rare earth material such as neodymium, wherein the magnet may be selectively positioned within the length of the armature to pre-select between a push-type, a pull-type or a dual acting solenoid thereby readily converting the functionality of the solenoid.

SUMMARY OF THE INVENTION

Briefly described, a solenoid body is combined with a non-magnetic armature tube which contains a permanent magnet having a length shorter than the length of the armature tube. A pole piece formed of a ferromagnetic material is disposed at each end of the solenoid body. Typically one pole piece (a "stop") is disposed at a closed end of the body and the other pole piece (a "collar") is disposed at an open end of the body through which a plunger connected to the armature tube projects and acts on a device controlled by the solenoid. The magnet may be positioned along the length of the armature tube in any one of a plurality of positions depending on the solenoid function desired. When the magnet's position is biased toward the open end of the solenoid body and its polarity arranged to move the armature away from the open end when the solenoid coil is energized, the solenoid functions as a pull-type solenoid. In this configuration, when the solenoid is de-energized, the plunger is held in an extended position by the magnetic attraction of the permanent magnet to the ferromagnetic collar. When the solenoid coil is energized, the force and polarity of the magnetic field causes the magnet and armature tube to move away from the collar and toward the ferromagnetic stop, thereby retracting the plunger. When the solenoid is again de-energized, and the magnetic force field generated by the coil collapses, the plunger re-extends as a result of the magnetic attraction of the permanent magnet to the collar. By reversing the polarity of the magnet (or reversing the direction of current flow through the coil), and by biasing the position of the magnet toward the closed end of the solenoid, the solenoid may be easily converted to function as a push-type solenoid.

If the magnet position is biased toward the ferromagnetic stop, the solenoid functions as a push-type solenoid. In this configuration, when the solenoid is de-energized, the plunger is held in the retracted position by the magnetic attraction from the permanent magnet to the ferromagnetic stop. When the solenoid coil is energized, the force and polarity of the magnetic field causes the magnet and armature tube to move away from the stop and toward the ferromagnetic collar, thereby extending the plunger. When the solenoid is again de-energized, the plunger retracts as a result of the magnetic attraction of the permanent magnet to the ferromagnetic stop.

In either configuration, no spring is required to return the armature to its de-energized position. Since the magnetic force attracting the magnet toward its de-energized position is greater than the magnetic attraction to the opposite pole piece, the armature tube containing the magnet will automatically return to whichever de-energized position has been pre-selected during manufacture or field setting of the solenoid.

A third function can be achieved by locating the permanent magnet at or near the middle of the length of the armature tube (the "neutral position") such that neither the solenoid stop nor the solenoid collar controls the position of the armature when the magnet is in the neutral (centered) position. Instead, the armature is balanced magnetically between the two solenoid ends. A positive pulse to the solenoid coil will move the armature in the direction of a first end of the solenoid, while a negative pulse will move the armature toward a second and opposite end. Through magnetic attraction of the permanent magnet to one of the pole pieces, the armature will remain at the end of the solenoid body to which it was directed until another pulse of opposite polarity is provided through the solenoid coil. Thus, this configuration functions as a dual acting solenoid that requires no continuous power, only magnetic attraction, to hold it in a deactivated position after pulsing.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently preferred embodiments of the invention, and such exemplifications are not to be construed as limiting the scope of the invention in any manner.

DESCRIPTION OF THE PREFERRED EMBODIMENTS

Figure 1B:
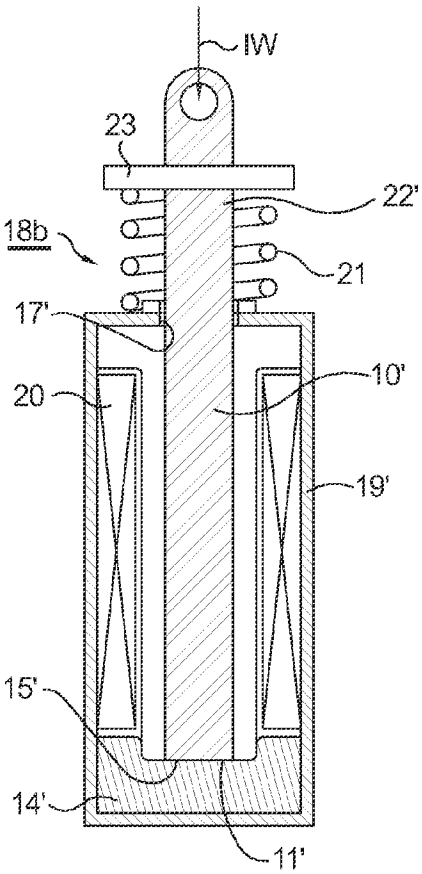
FIG. 1B. (PRIOR ART)
FIG. 1B is a schematic drawing showing a prior art "pull" type solenoid.
Figure 1A:
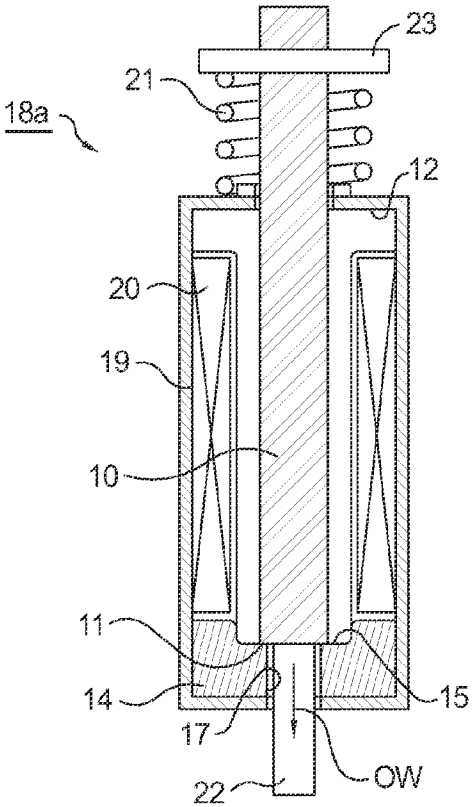
FIG. 1A. (PRIOR ART)
FIG. 1A is a schematic drawing showing a prior art "push" type solenoid.

FIGS. 1A and 1B show two prior art solenoids—one a push-type solenoid (FIG. 1A) and the other a pull-type solenoid (FIG. 1B). Referring to FIG. 1A, push-type solenoid 18*a* comprises housing 19, an electromagnetic coil 20 surrounding an armature 10 and disposed within the housing between a ferromagnetic pole piece collar 14 and a partially closed end of the housing referred to as an armature backstop 12. Armature 10 includes a section 11 engageable with a similarly contoured collar seat 15 when the coil is energized. Non-magnetic push rod plunger 22, extending beyond section 11, extends through an opening 17 provided in the collar and housing. Coil spring 21, disposed between an end wall of the housing and pin 23 pressed into armature 10, biases the armature away from the pole piece collar 14 and provides the motivating force to move the armature away from the collar, thereby retracting the plunger when the coil is de-energized. Thus, when the coil is energized as shown, the plunger provides a pushing force directed outwardly (arrow OW) from the solenoid.

Referring to FIG. 1B, pull-type solenoid 18*b* is shown. The solenoid comprises within the housing between a ferromagnetic pole piece stop 14' and an open end of the housing. Armature 10' may include a section 11' engageable with a similarly contoured stop seat 15' when the coil is energized. Pull rod plunger 22' extends from the armature at an armature end opposite section 11' of the armature. Plunger 22' extends through an opening 17' provided in housing. Coil spring 21 disposed between pin 23 and an end wall of the housing biases the armature away from the pole piece stop and provides the motivating force to move the armature away from the stop, thereby extending the plunger when the coil is de-energized. Thus, when the coil is energized as shown, the plunger provides a pulling force directed inwardly (arrow IW) of the solenoid.

It is important to note that, in these two prior art solenoids, many components are not interchangeable. For example, an armature used in a pull-type solenoid cannot be used in a push-type solenoid. The pole piece used in a pull-type solenoid cannot be used in a push-type solenoid. Thus, inventory costs increase and assembly procedures are more complicated. Moreover, once a solenoid is assembled as either a push or a pull-type solenoid, it cannot be readily and inexpensively changed to the other type. These issues and others are alleviated by the embodiments of the invention now described.

Figure 2:
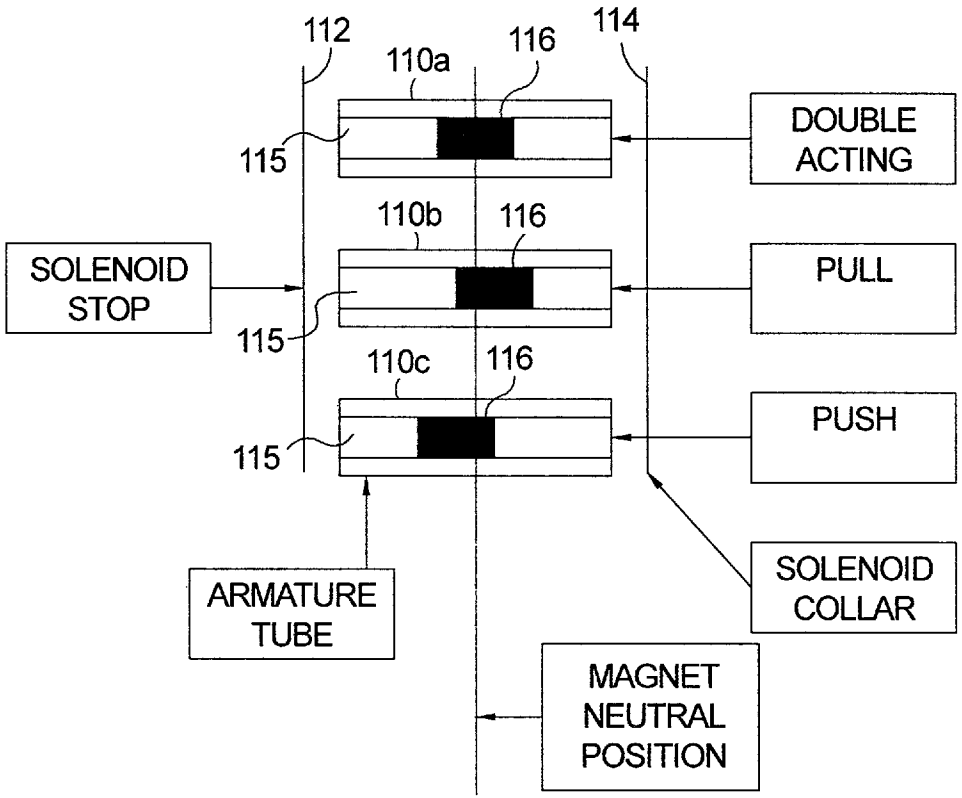
FIG. 2 is a schematic drawing showing three different embodiments of an armature in accordance with the present invention in relationship to a solenoid stop and a solenoid collar.
Figure 3:
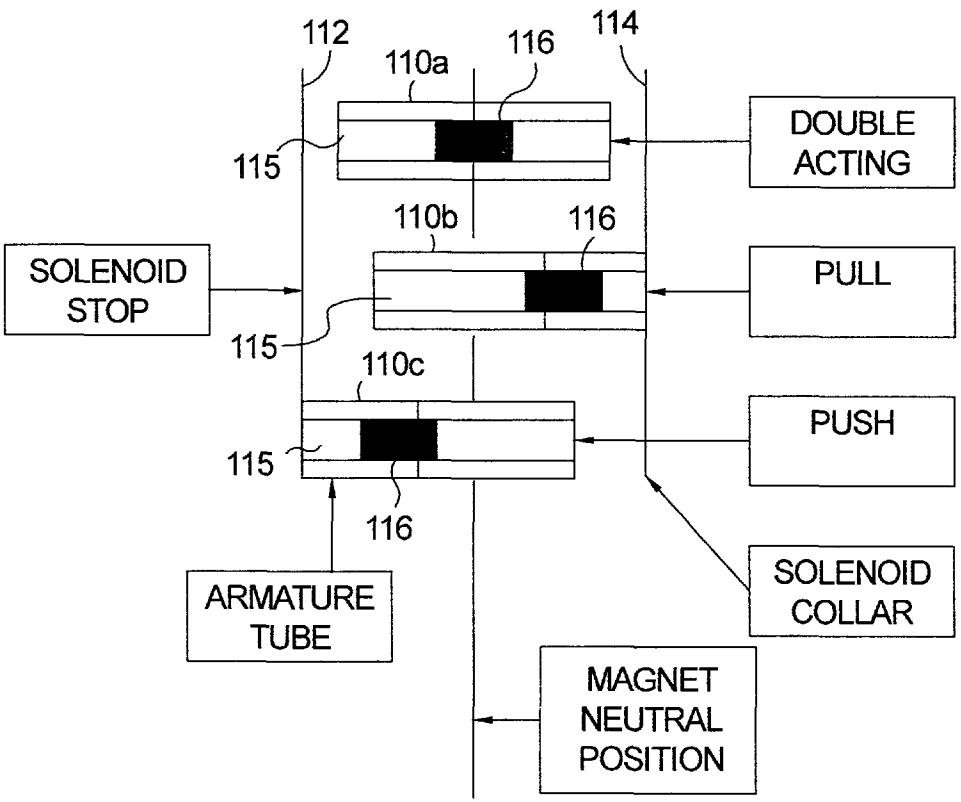
FIG. 3 is a schematic drawing like that shown in FIG. 2 showing the rest positions of two of the embodiments (10b and 10c) and the neutral position of the third embodiment (10a)

Referring to FIGS. 2 and 3, three different configurations of a solenoid armature tube in accordance with the present invention are shown schematically in relationship to a solenoid stop disposed at one end of the armature and a solenoid collar disposed at the other end of the armature.

In FIG. 2, the armature tubes 115 are shown at a centered position between the solenoid stop 112 and the solenoid collar 114 to illustrate the differing construction of the three configurations. In configuration 110*a*, a magnet 116, preferably a high energy rare earth magnet made of neodymium, for example, is disposed at a midpoint within a non-ferromagnetic armature tube 115, which may be tubular, such that, in the absence of a solenoid-coil magnetic field, armature 110*a* is equally attracted to the stop and to the collar.

In configuration 110*b*, magnet 116 is disposed nearer to solenoid collar 114 such that, in the absence of a solenoid-coil magnetic field, armature 110*b* is attracted toward the collar.

In configuration 110*c*, a magnet 116 is disposed nearer to solenoid stop 112 such that, in the absence of a solenoid-coil magnetic field, armature 110*c* is attracted toward the stop.

In FIG. 3, armatures 110*b* and 110*c* are shown respectively at rest in the absence of a solenoid-coil magnetic field. Since magnet 116 is disposed within armature 110*b* closer to the solenoid collar, it is attracted to the collar, thereby positioning the armature toward the solenoid collar. Similarly, since magnet 116 is disposed within armature 110*c* closer to the solenoid stop, it is attracted to the stop, thereby positioning the armature toward the solenoid collar stop. Armature 110*a* is shown in FIG. 3 having its magnet positioned in the middle of the armature and shown in a neutral position half way between the stop and collar.

Figure 9B:
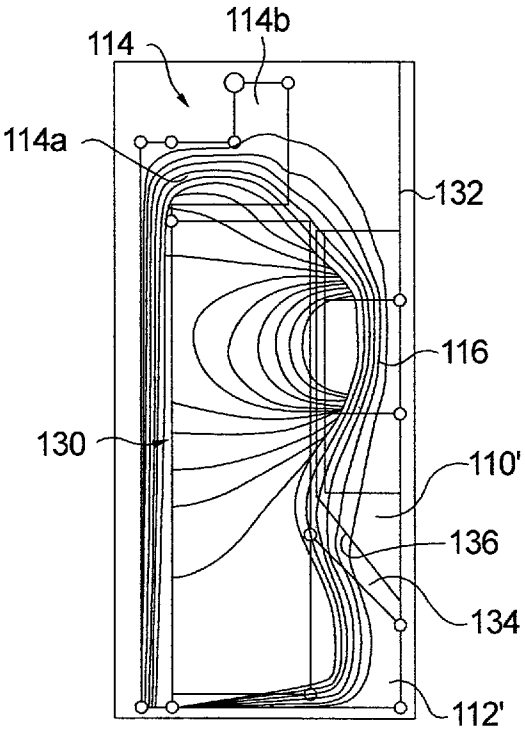
FIGS. 9A and 9B are cross-sectional views of a further embodiment showing special collar and stop designs and their influence on the lines of force with the coil energized (9A) and de-energized (9B), in accordance with the invention.
Figure 9A:
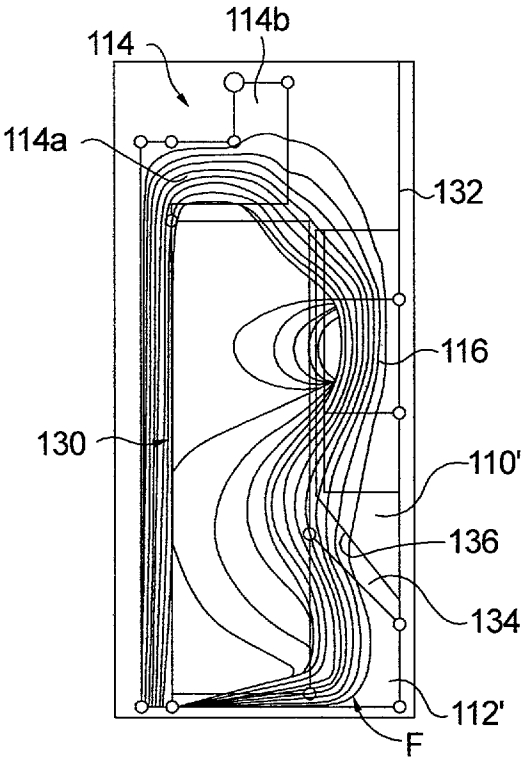

Referring to FIGS. 4 through 7, a standard solenoid body 118 comprises an electromagnetic coil 120 surrounding an armature and disposed between ferromagnetic solenoid stop 112 and ferromagnetic solenoid collar 114 through which extends armature plunger 122 in known fashion. Both stops 112 and collar 114 preferably but not necessarily are formed having a flange 112*a*,114*a* and a narrower boss 112*b*,114*b*, respectively. To influence the force-travel characteristic curve of the device, boss 114*b* may extend either inwards from flange 114*a*, as shown, or outwards from flange 114*a* (FIGS. 9A and 9B). A non-magnetic armature 110*a*, 110*b*, 110*c* contains magnet 116, which may be shorter than the length of a standard soft iron armature and which may be selectively positioned at any one of a plurality of longitudinal positions within the armature 110*a*, 110*b*, 110*c*.

Figure 5:
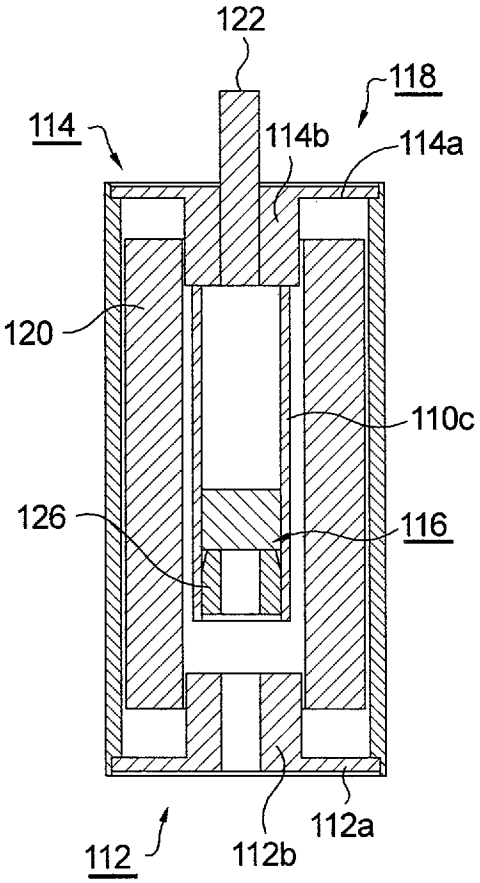
FIG. 5 is a cross-sectional view like that shown in FIG. 4, showing the armature lifted off the solenoid stop when the coil is energized (push function)

As described above and shown in FIGS. 4 and 5, if the permanent magnet's position in the armature 110*c* is biased toward the stop end 112 of the solenoid, the unit will act as a push solenoid, i.e., it will be held in the plunger retracted position (FIG. 4) solely by magnetic attraction between permanent magnet 116 and solenoid stop 112 when the solenoid is not energized. When solenoid coil 120 is energized, as shown in FIG. 5, armature tube 110*c* will move (be "pushed") away from stop end 112 to extend plunger 122.

Figure 7:
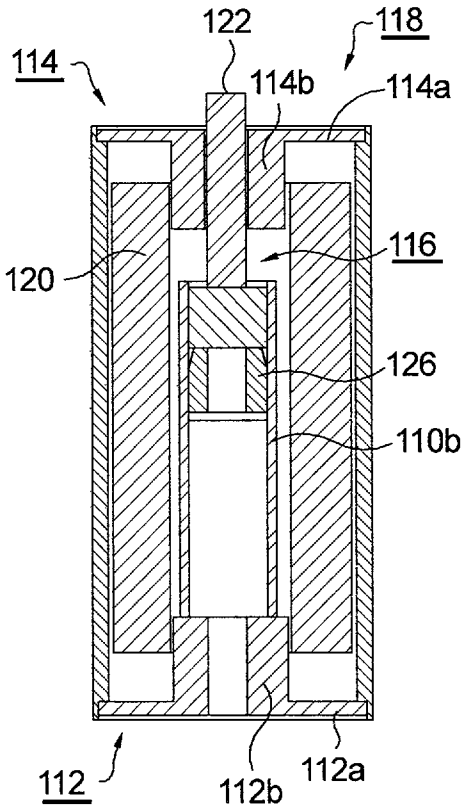
FIG. 7 is a cross-sectional view like that shown in FIG. 6, showing the armature pulled away from the solenoid collar when the coil is energized.

Conversely, as described above and shown in FIGS. 6 and 7, if the permanent magnet's position is biased toward the collar end 114 of the solenoid, the solenoid will act as a pull solenoid, i.e., it will be held in the plunger-extended position (FIG. 6) solely by magnetic attraction between permanent magnet 116 and collar boss 114*b*. When solenoid coil 120 is energized, as shown in FIG. 7, armature tube 110*b* will move (be "pulled") away from collar boss 114 to retract plunger 122.

It is an important advantage of the present invention that a push-type solenoid can be converted to a pull-type solenoid (or vice-versa) by repositioning the magnet along the longitudinal length of the armature tube and changing the polar orientation of the magnet relative to the direction of current flow such as, for example, by either reversing the polar orientation of the magnet or by reversing the direction of the flow of current through the solenoid coil.

It is a further advantage of the present invention that in either the push or pull case, no spring is required to return the armature to one extreme or the other when the solenoid coil is de-energized; the armature tube containing the magnet will automatically return to its de-energized position because of the pre-positioning of the magnet within the armature tube.

Figure 4:
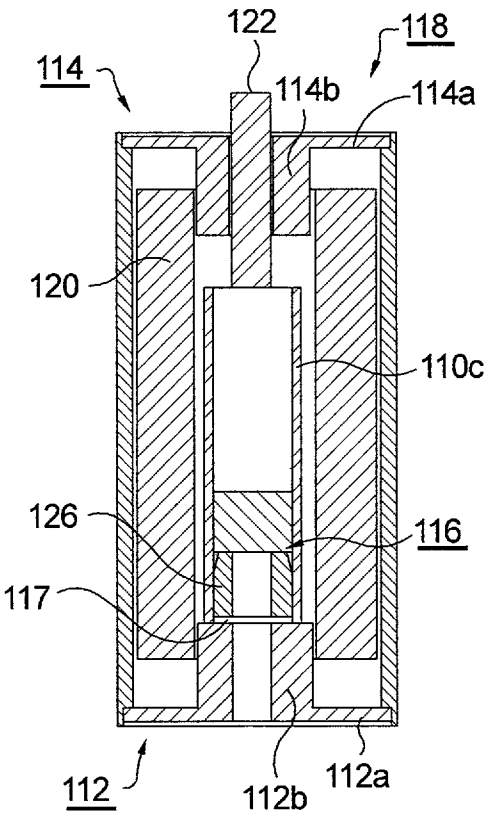
FIG. 4 is a cross-sectional view of one configuration of the invention showing the magnet displaced toward the solenoid stop from the center point of the armature, a plunger-retracted mode with the solenoid coil de-energized.
Figure 6:
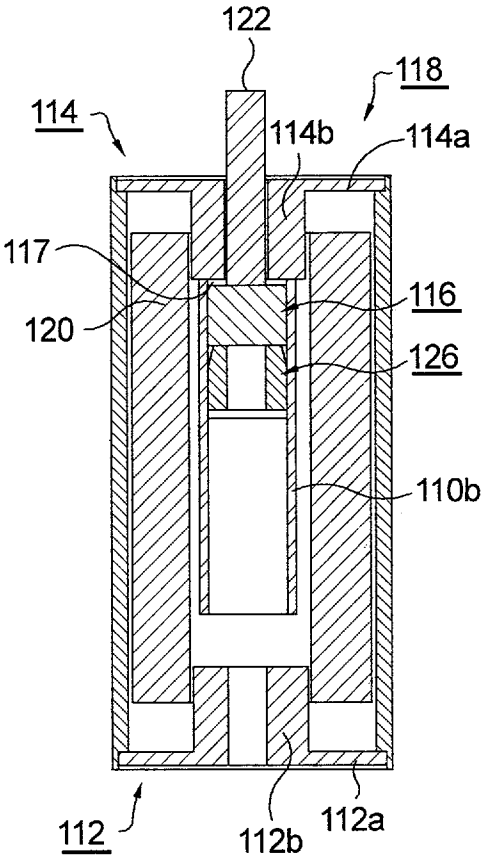
FIG. 6 is a cross-sectional view of another configuration of the invention showing the magnet displaced toward the solenoid collar from the center point of the armature, a plunger-extended mode with the solenoid coil de-energized

It is also important to note that, since magnet 116 is disposed within armatures 110*a*, 110*b* so that an end of the armature extends slightly beyond magnet 116, a slight air gap 117 may be maintained between the magnet 116 and solenoid stop 112*b* and solenoid collar 114*b* when the coils are in their respective de-energized modes (see FIGS. 4 and 6, respectively). Thus, residual magnetism will not momentarily delay or prevent the movement of the armatures when the coils are energized.

Figure 8B:
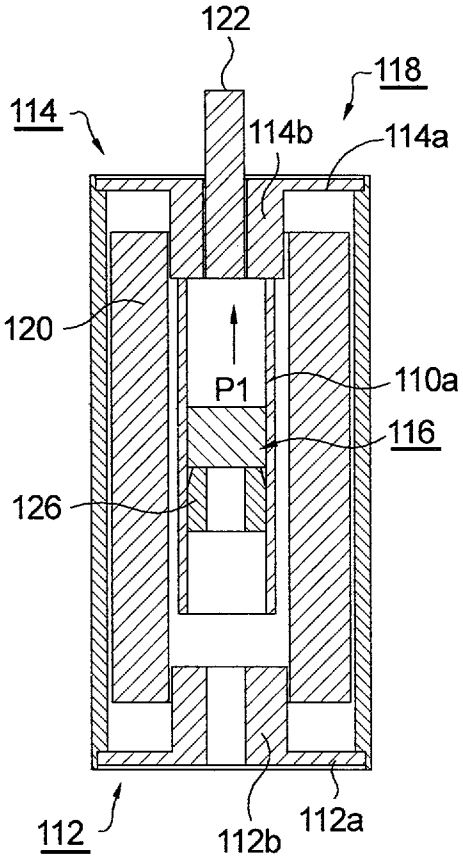
FIGS. 8A and 8B are a cross-sectional view of another configuration of the invention showing the position of the magnet in a dual acting solenoid.
Figure 8A:
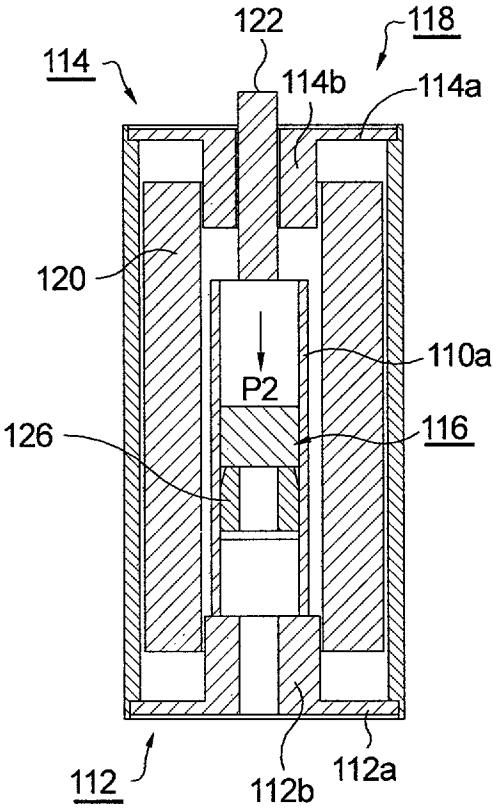

As described above, a third function can be achieved by locating the permanent magnet 16 at or about the middle of armature 110*a*. In this position, neither the solenoid stop 112 nor the solenoid collar 114 repeatedly controls the position of the armature. Instead, armature 110*a* is balanced magnetically between the two solenoid ends at a starting point. Referring to FIG. 8A, permanent magnet 116 at rest would be centered within armature 110*a*. As shown, the armature is biased toward solenoid stop 112 in the direction P2 as the result of a negative pulse, that is, when the direction of current through coil 120 causes the magnet 116 to be attracted toward stop 112 and to be repelled away from collar 114. FIG. 8B shows the position of the armature (plunger extended) after the current direction is reversed and a positive pulse is directed through coil 120. The pulse moved the armature in the P1 direction, opposite direction P2. Following the pulse, the armature will remain in the position shown in FIG. 8B because magnet 116 has moved closer to collar 114 and is attracted to collar 114. A subsequent negative pulse (P2) directed through coil 120 will move the armature in a second and opposite direction, assuming the position shown in FIG. 8A (plunger retracted). Following either pulse, the armature will remain at the end to which it was directed because of the magnet's attraction to either the stop or collar until another pulse of opposite polarity comes along. Thus this is a dual acting solenoid. The advantage of a dual acting solenoid is that it requires no additional power to hold the plunger in either an extended or retracted position.

Note that the operating mode of the solenoid (push, pull, or double-acting) may be selected prior to use by simply positioning or repositioning the magnet within the armature to any of several positions generally shown in FIG. 2.

Referring to FIGS. 9A and 9B, a cross-sectional view of one-half of a solenoid, left of the solenoid's center line 132 is shown, depicting how a magnet/armature in accordance with the present invention can work in a conventional solenoid body. In these figures, conventional configurations of the collar and stop bosses are shown. Non-planar concave surface 134 of stop 112' face the armature and a non-planar convex end surface 136 of armature 110' face stop 112'. Both of these surfaces 134,136 are preferably conical although not necessarily of the same internal cone angle. Collar boss 114*b* as shown extends outward from flange 114*a*.

It has been found that these stop/collar configurations, either separately or in combination, influence the magnetic lines of force and may be manipulated to enhance the magnetic attraction between magnet 116 and stop 112' and between magnet 116 and collar 114. In FIGS. 9A and 9B, exemplary lines of magnetic flux 130 are shown emanating from magnet 116 to the left of solenoid center line 132. It should be understood, of course, that identical flux lines exist over the right half of the solenoid but are omitted herein for clarity. As depicted in FIG. 9A, magnet 116 is held in a central position between collar 114' and stop 112' while the coil is energized; in FIG. 9B, the coil is not energized while the magnet is held in its central position. As can be seen, in the configured collar and stop bosses, more magnetic flux lines (F) are directed toward the conical stop boss when the coil is energized (FIG. 9A). This results in an axial force which moves the armature toward the collar.

Figure 10D:
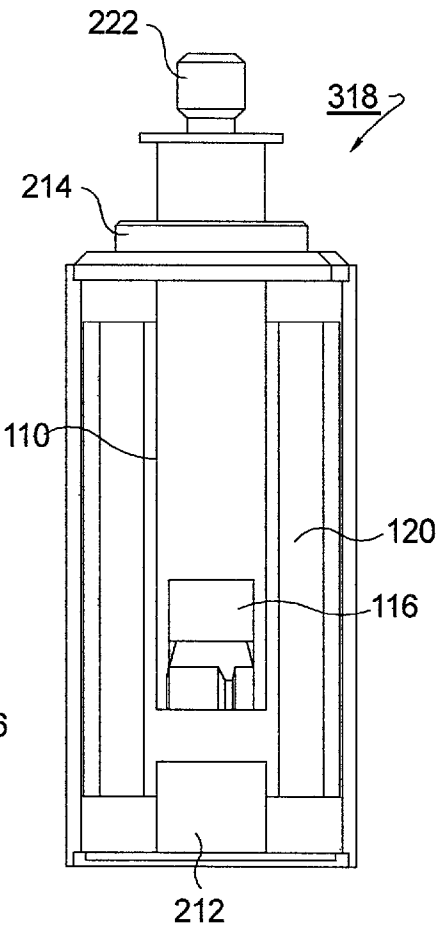
FIGS. 10A-10D are cross sectional views of a solenoid used in an electric door latching application, in accordance with the invention.
Figure 10C:
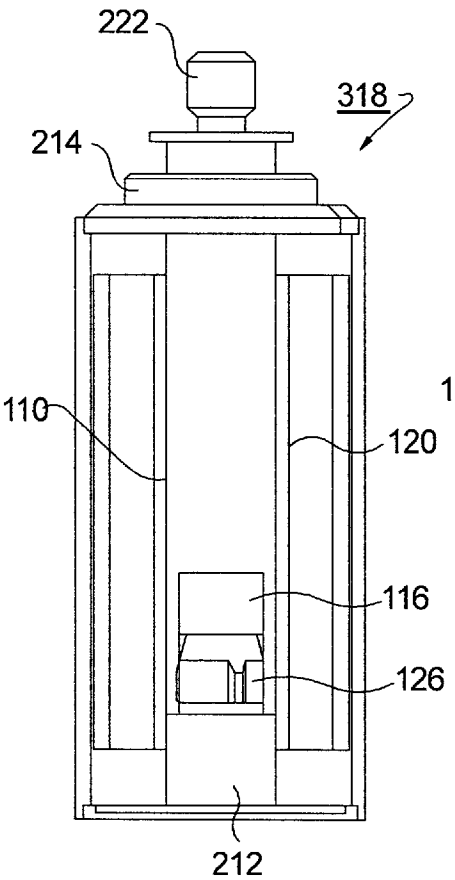
Figure 10B:
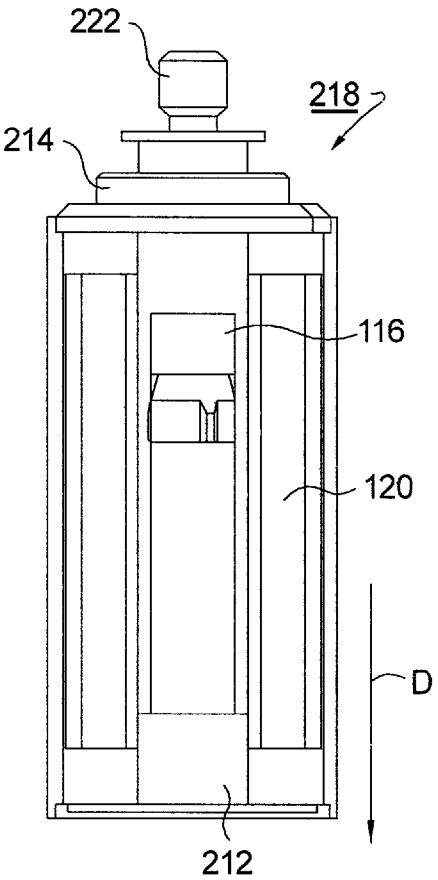
Figure 10A:
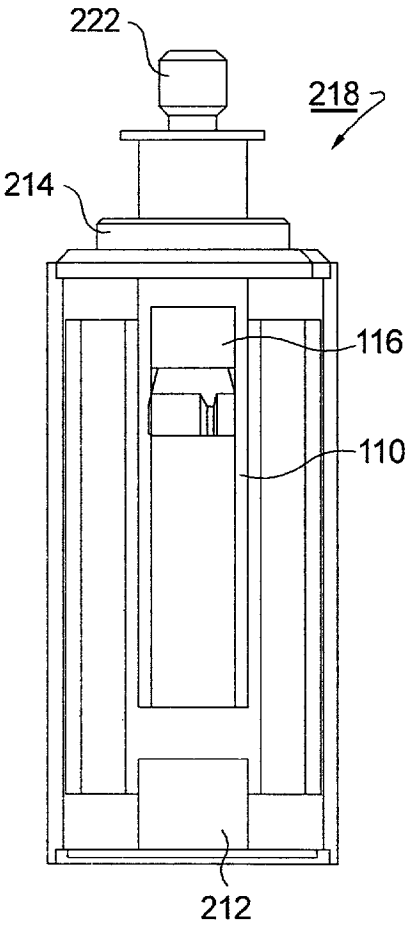

The electromagnet actuator in accordance with the invention is specifically adaptable to an electric door latching mechanism. As known in the art, an electric solenoid may be used in conjunction with an electric strike to either block a strike keeper from movement in a first plunger position, thereby securing a latch to the strike, or unblock the strike keeper in a second plunger position, thereby allowing the keeper to rotate and release the latch from the strike. In such applications, the plunger acts directly on a blocker to move it between a blocking position and an unblocking position. The aforementioned electric strikes are provided as either a fail-safe strike wherein when the solenoid coil is de-energized, the keeper is unblocked and the latch is released, or a fail-secure strike wherein when the solenoid coil is de-energized, the keeper is blocked and the latch is secured. Referring to FIG. 10A, a de-energized, fail-secure electric strike solenoid 218 is shown. In this configuration, permanent magnet 116 is disposed in armature tube 110 closer to ferromagnetic collar 214 than to stop 212. The magnetic attraction of magnet 116 to collar 214 draws the armature and magnet closer to collar 214, thereby extending plunger 222 to block the electric strike keeper (not shown) when the coil is not energized. Referring now to FIG. 10B, an energized, fail secure electric strike solenoid is shown. With the proper direction of current flow selected while coil 120 is energized, the magnetic attraction of magnet 116 to stop 212 will overcome the magnetic attraction of the magnet to collar 214 causing the armature and magnet to move toward the stop in direction D and cause plunger 222 to retract and unblock the keeper (not shown) of the electric strike. Referring to FIG. 100, a de-energized, fail-safe electric strike solenoid 318 is shown. In this configuration, permanent magnet 116 is disposed in armature tube 110 closer to ferromagnetic stop 212 than to collar 214. The magnetic attraction of magnet 116 to stop 212 draws the armature and magnet closer to stop 212, thereby retracting the plunger to unblock the electric strike keeper (not shown) when the coil is not energized. Referring now to FIG. 10D, an energized, fail safe electric strike solenoid is shown. With the proper direction of current flow selected while coil 120 is energized, the magnetic attraction of magnet 116 to collar 214 will overcome the magnetic attraction of the magnet to stop 212 causing the armature and magnet to move toward the collar and cause plunger 222 to extend and block the keeper (not shown) of the electric strike.

In the several configurations shown (FIGS. 10A, 10B, 10C, 10D), after permanent magnet 116 is selectively positioned within the armature, the magnet may be held in its selected position by any means. In the example shown, magnet 116 may be first fixed to plug 126 with epoxy, for example. Then plug/magnet 126/116 may be secured in place by a press-fitting arrangement between the plug and an internal bore of the armature.

In the prior art, it was necessary to either fabricate an electric strike mechanism to be specifically a fail-safe or fail-secure strike or to incorporate elaborate adjustable features into the mechanics of the strike to be able to convert a strike from a fail-safe to fail-secure strike, or vice-versa. As can be seen by the instant invention, a single strike can be readily converted from a fail-secure to a fail-safe, or vice-versa, by simply repositioning the permanent magnet in the tubular armature and changing the direction of current flow through the coil, or inverting the polarity of the permanent magnet as needed.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A solenoid selectively switchable between a plurality of operating modes, the solenoid having an armature slidably disposed within a housing, said armature comprising:

an elongate non-ferromagnetic element having a longitudinal length; and a magnetic element shorter in length than said longitudinal length of said non-ferromagnetic element, wherein said magnetic element is supported by said non-ferromagnetic element, wherein said magnetic element is selectively disposable at any one of a plurality of longitudinal positions relative to said non-ferromagnetic element along said longitudinal length of said non-ferromagnetic element to define any one of said plurality of operating modes of the solenoid.

2. The solenoid in accordance with claim 1 wherein said magnetic element includes neodymium.

3. The solenoid in accordance with claim 1 wherein said non-ferromagnetic element is tubular.

4. The solenoid in accordance with claim 3 wherein said magnetic element is disposed within said tubular element.

5. The solenoid in accordance with claim 1 wherein said magnetic element is disposed at about a center of said longitudinal length of said non-ferromagnetic element.

6. The solenoid in accordance with claim 1 wherein said magnetic element is disposed near an end of said non-ferromagnetic element.

7. The solenoid in accordance with claim 1 further comprising a plunger fixedly coupled with said non-ferromagnetic element.

8. The solenoid in accordance with claim 1 wherein an opening is defined in said housing, and wherein said plunger extends through said opening.

9. The solenoid in accordance with claim 1 wherein said plurality of longitudinal positions includes a first position and a second position, wherein said plurality of operating modes incudes a pull mode and a push mode, wherein said first position defines said pull mode, and wherein said second position defines said push mode.

10. The solenoid in accordance with claim 9 wherein said plurality of longitudinal positions includes a third position, wherein said third position is disposed between said first position and said second position, wherein said plurality of operating modes incudes a neutral mode, and wherein said third position defines said neutral mode.

11. A solenoid selectively switchable between a plurality of operating modes, said solenoid comprising:

a) an electromagnetic coil; and b) an armature disposed within said electromagnetic coil, wherein said armature includes a non-ferromagnetic element having a longitudinal length, and a magnetic element supported by said non-ferromagnetic element, wherein said magnetic element is selectively disposable at any one of a plurality of longitudinal positions relative to said non-ferromagnetic element along said longitudinal length of said non-ferromagnetic element to define any one of a plurality of operating modes of said solenoid.

12. The solenoid in accordance with Claim 11 further comprising:

a) a ferromagnetic collar bounding a first end of said electromagnetic coil; and b) a ferromagnetic stop bounding a second end of said electromagnetic coil.

13. The solenoid in accordance with claim 12 wherein said magnetic element is disposed at about a center of said longitudinal length of said non-ferromagnetic element.

14. The solenoid in accordance with claim 12 wherein said magnetic element is disposed near a first end of said non-ferromagnetic element adjacent said ferromagnetic collar.

15. The solenoid in accordance with claim 12 wherein said magnetic element is disposed near a second end of said non-ferromagnetic element adjacent said ferromagnetic stop.

16. The solenoid in accordance with claim 12 wherein said ferromagnetic stop includes a first non-planar surface facing said armature.

17. The solenoid in accordance with claim 16 wherein said armature includes a second non-planar surface facing said ferromagnetic stop.

18. The solenoid in accordance with claim 17 wherein at least one of said first and second non-planar surfaces is conical.

19. The solenoid in accordance with claim 11 wherein said magnetic element includes neodymium.

20. The solenoid in accordance with claim 11 wherein said non-ferromagnetic element is tubular.

21. The solenoid in accordance with claim 20 wherein said magnetic element is disposed within said tubular element.

22. A solenoid selectively switchable between a plurality of operating modes, the solenoid having an armature comprising:

an elongate non-ferromagnetic element having a longitudinal length;

a plunger fixedly coupled with said non-ferromagnetic element; and a magnetic element shorter in length than said longitudinal length of said non-ferromagnetic element, wherein said magnetic element is supported by said non-ferromagnetic element, wherein said magnetic element is selectively disposable at any one of a plurality of longitudinal positions relative to said non-ferromagnetic element along said longitudinal length of said non-ferromagnetic element to define any one of said plurality of operating modes of the solenoid.

* * * * *